US005852396A

United States Patent [19]

Borchardt

[11] Patent Number: 5,852,396

[45] Date of Patent: Dec. 22, 1998

[54] FUSIBLE ELEMENT WITH HIGH SURGE CAPABILITY

[75] Inventor: Glenn R. Borchardt, Round Lake Beach, Ill.

[73] Assignee: S&C Electric Company, Chicago, Ill.

[21] Appl. No.: 914,574

[22] Filed: Aug. 19, 1997

[51] Int. Cl.[6] ..... H01H 37/76; H01H 85/04; H01H 71/10

[52] U.S. Cl. ..... 337/174; 337/159; 337/172; 337/173; 337/402; 337/142

[58] Field of Search ..... 337/142, 148, 337/149, 150, 151, 152, 153, 154, 155, 158, 159, 160, 161, 162, 170, 171, 172, 173, 174, 175, 176, 177, 178, 179, 402

[56] References Cited

U.S. PATENT DOCUMENTS 4,210,893 7/1980 Hara ..... 337/407

*Primary Examiner*—Gregory Thompson
*Assistant Examiner*—Anatoly Vortman
*Attorney, Agent, or Firm*—James V. Lapacek

[57] ABSTRACT

A fusible element is provided that includes cooperating interfitting parts surrounded by fusible material. The cooperating interfitting parts are arranged so as to place compressive force on the fusible material in response to attempted separation of the interfitting parts. Further, the arrangement also reduces the forces on the fusible material. In response to a predetermined time-current condition, the fusible material softens sufficiently to permit the release and separation of the interfitting parts.

10 Claims, 3 Drawing Sheets

FUSIBLE ELEMENT WITH HIGH SURGE CAPABILITY

BACKGROUND OF THE INVENTION

1. Field of the Invention

The present invention relates generally to fusible elements for circuit-interrupting devices such as fuses, cutouts and the like and more particularly to a fusible element having improved reliability and operating characteristics so as to provide high surge capability to avoid undesirable nuisance operations.

2. Description of the Related Art

Various types of circuit interrupting devices in the electrical power distribution and transmission field utilize fusible elements that are designed to provide desirable circuit interrupting characteristics, i.e. time-current characteristics. The available time-current characteristics include protection against fault currents and other overload currents. For example, ANSI standard C37.42 describes various time-current characteristics. The circuit-interrupting devices are utilized at different locations in the electrical systems to provide different functions along with coordinating with one another to provide the most reliable system and minimize outages and the number of affected power users on the system. In certain applications, it is desirable to provide both fault protection and overload protection while avoiding nuisance outages in response to defined high-surge conditions which are defined in terms of current and time, e.g. $i^2t$. For example, for various specific applications, it is desirable to avoid operation unless the current exceeds a specific percentage of rated current, e.g. 130–150% of rated current.

One type of device for this purpose is a dual element fuse link which includes a first fusible element that responds to fault currents according to predetermined time-current characteristics and a second fusible element that provides high-surge withstand capabilities while responding to lower overcurrents in accordance with i2t characteristics. For example, dual element fuse links of this type are described in the following U.S. Pat. Nos. 2,361,666; 2,416,428; 2,493,601; and 4,994,779, and in Cooper Power Systems D-Link Fuse Bulletin 90016, Jun., 1990. The fuse link in U.S. Pat. No. 2,493,601 includes engageable members are held together by a fusible metal which melts upon the occurrence of sustained low current heating to permit sliding separation of the members. In U.S. Pat No. 2,361,666, a fusible link includes hook-engaged members surrounded by a bead of low melting point metal. When the bead is softened by current flow, the members which are under tension are pulled apart via straightening of the hooked engagement portions.

These types of fuse links can be utilized with various circuit-interrupting devices, e.g. two illustrative types being shown in U.S. Pat. Nos. 4,307,369, 4,317,099 and 5,502,427.

While the fusible elements of the prior art may be generally suitable for their intended uses, they may still be subject to nuisance outages as a result of undesirable operation in response to prolonged low overload or surge currents.

SUMMARY OF THE INVENTION

Accordingly, it is a principal object of the present invention to provide a fusible element having high-surge withstand capabilities that is not susceptible to prolonged low overload or surge currents.

It is another object of the present invention to provide a fusible element that includes cooperating interfitting parts surrounded by fusible material with the parts being arranged to place compressive force on the fusible material in response to separation of the interfitting parts such that in response to a predetermined time-current condition, the fusible material softens sufficiently to permit the release and separation of the interfitting parts.

It is a further object of the present invention to provide a fusible element that includes cooperating interfitting parts surrounded by fusible material with the parts being arranged to reduce the forces on the fusible material in response to separation of the interfitting parts, i.e. such that the fusible material is under less mechanical load.

These and other objects of the present invention are efficiently achieved by a fusible element that includes cooperating interfitting parts surrounded by fusible material. The cooperating interfitting parts are arranged so as to place compressive force on the fusible material in response to attempted separation of the interfitting parts. Further, the arrangement also reduces the forces on the fusible material. In response to a predetermined time-current condition, the fusible material softens sufficiently to permit the release and separation of the interfitting parts.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
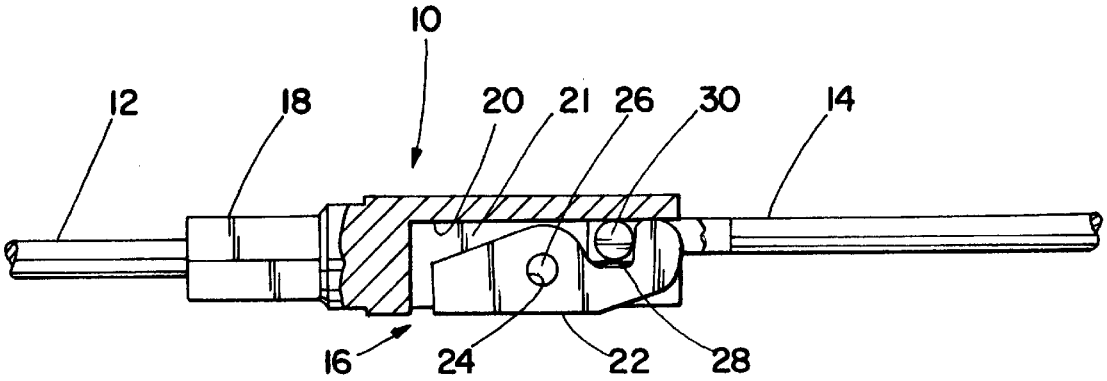
FIGS. 1–4 are front elevational views, partly in section, of a fusible element in accordance with a first embodiment of the present invention and illustrating various operational stages.

Referring now to FIGS. 1–6, a fusible element 10 in accordance with a first embodiment of the present invention includes first and second conductors 12, 14 and an electrothermally responsive arrangement 16 that responds to predetermined time-current conditions to cause separation of the conductors 12, 14. The electrothermally responsive arrangement 16 includes a first terminal 18 carried on the first conductor 12 having an elongated cavity 20. A latch lever 22 is pivotally mounted within the cavity 20 at a pivot point 24 by a pin 26. The latch lever 22 includes a receiver notch 28. The second conductor 14 is provided with a hook section 30 which is assembled into the receiver notch 28 with fusible material 21 disposed within the cavity 20 surrounding the latch lever 22 and the hook 30. In the position shown in FIG. 1, under normal operating conditions, the conductors 12, 14 are prevented from separating due to the rigidity of the fusible material 21. In typical applications, the fusible material 21 is of the type (e.g. solder or the like) which dramatically exhibits decreased strength and rigidity for increasing temperatures.

Figure 2:
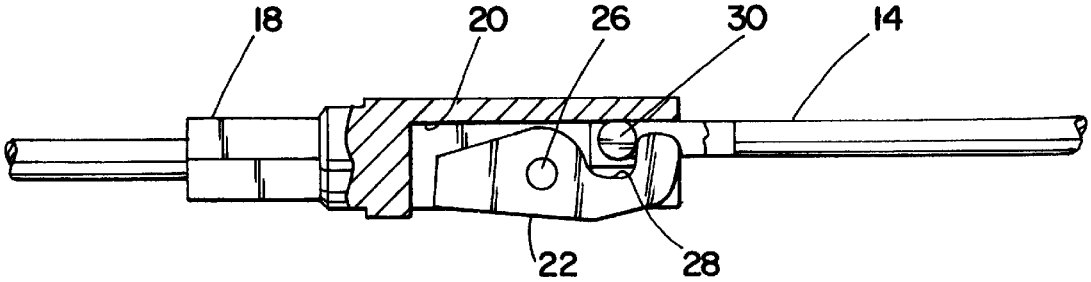
Figure 3:
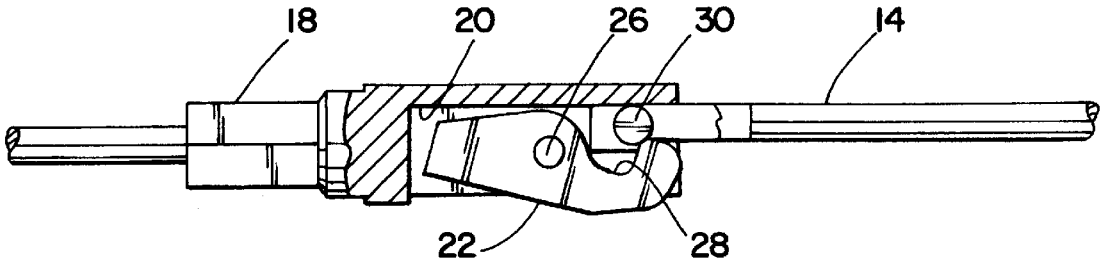
Figure 4:
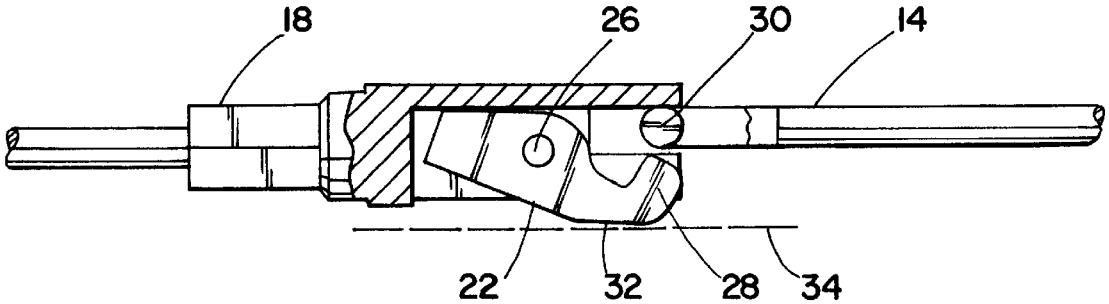

When the conductors 12, 14 are placed in tension, forces tending to separate the latch lever 22 and the hook 30 place the fusible material 21 in compression and the arrangement reduces the forces on the fusible material 21 relative to the tension on the conductors 12, 14, i.e. in compression, the fusible material 21 has more strength, and there is less mechanical load on the fusible material 21 relative to conventional arrangements where the conductors 12, 14 are merely attached. When the fusible material 21 melts, the latch lever 22 pivots as shown in FIGS. 2–4 so as to release the hook 30 and permit separation of the conductors 12,14. In accordance with a preferred embodiment, the latch lever 22 includes a tapered outer periphery at 32 so as to provide clearance as the latch lever 22 pivots, e.g. so as to minimize the required clearance to a wall 34 of a sheath or the like when the fusible element 10 is utilized in a conventional fuse link assembly. In one exemplary embodiment, the conductors 12, 14 are fabricated form Nichrome wire.

Figure 5:
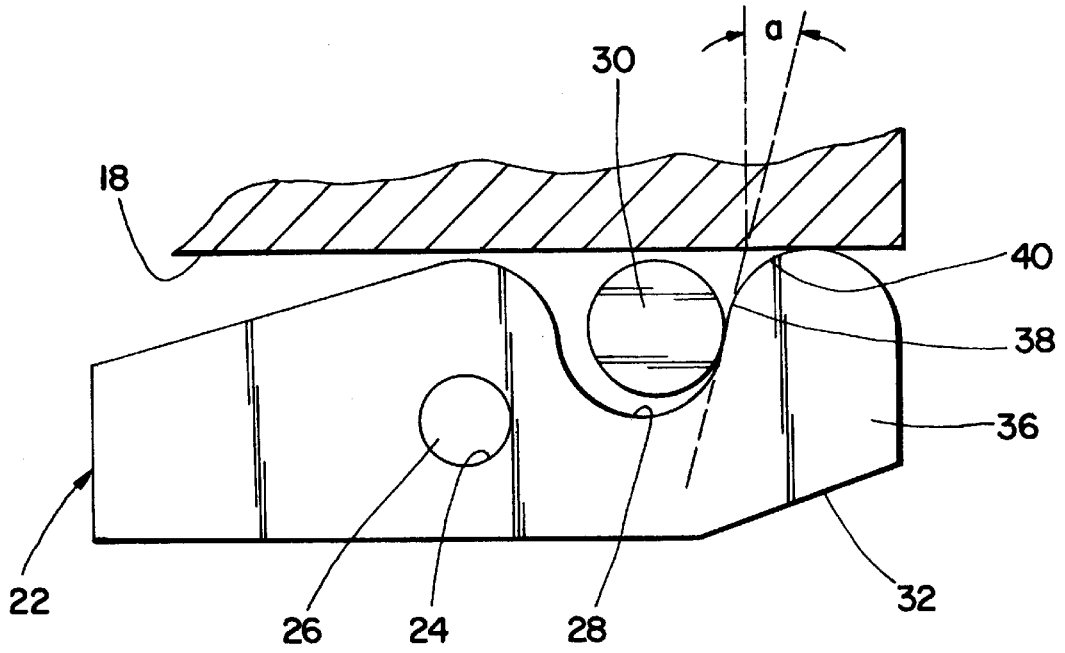
FIG. 5 is an enlarged partial view of the fusible element of FIGS. 1–4.
Figure 6:
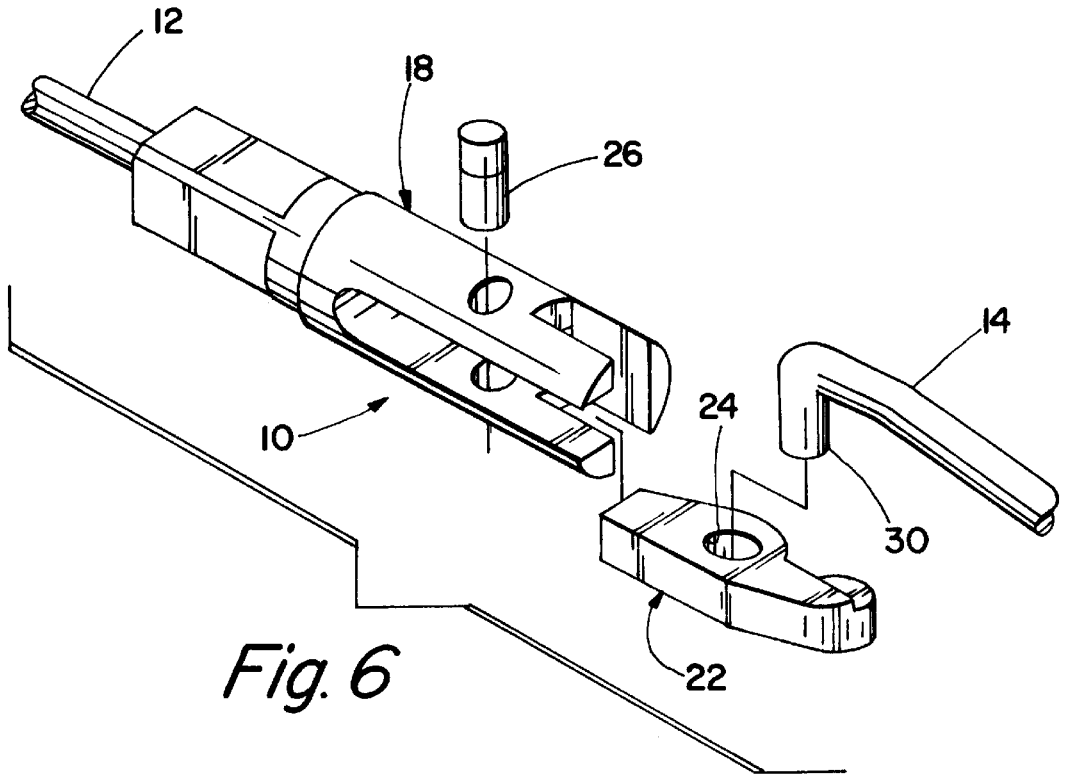
FIG. 6 is an exploded perspective view of the fusible element of FIGS. 1–5.
Figure 7:
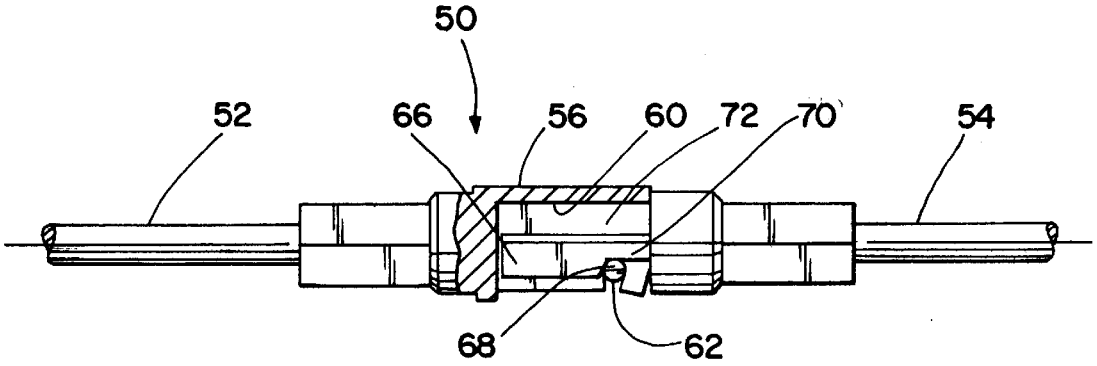
FIGS. 7–10 are front elevational views, partly in section, of a fusible element in accordance with a second embodiment of the present invention and illustrating various operational stages.

Referring now to FIG. 5 and considering additional important aspects of the present invention, the latch lever 22 at a latch arm portion 36 includes a ramp surface 38 adjacent the receiver notch 28. The ramp surface 38 is arranged with respect to the pivot point at 24 so as to provide a constant, sufficient force in the opening direction to overcome frictional forces as the hook 30 moves along the ramp surface 38. The latch arm portion 36 at 40 includes a more pronounced curvature such that the force increases as the hook 30 moves passed the ramp surface 38, thus ensuring appropriate release of the hook 30 as the latch lever 22 pivots. With the relative configuration and geometry as shown in FIG. 5, an angle "a" (as defined as shown in FIG. 5) of approximately 6 degrees for the ramp surface 38 has been found suitable to provide sufficient opening forces to overcome frictional forces and pivot the latch lever 22 while minimizing the forces on the fusible material 21, thus enhancing the desired overload and high-surge withstand characteristics.

Figure 8:
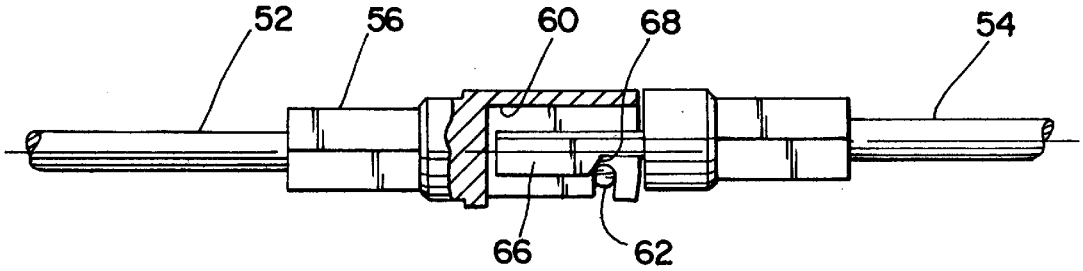
Figure 9:
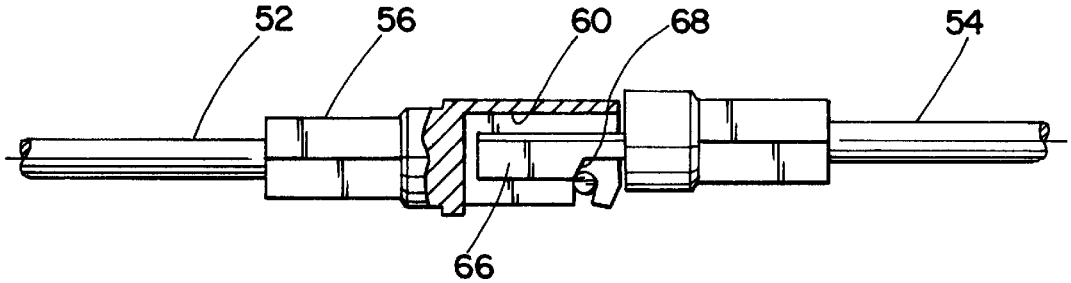
Figure 10:
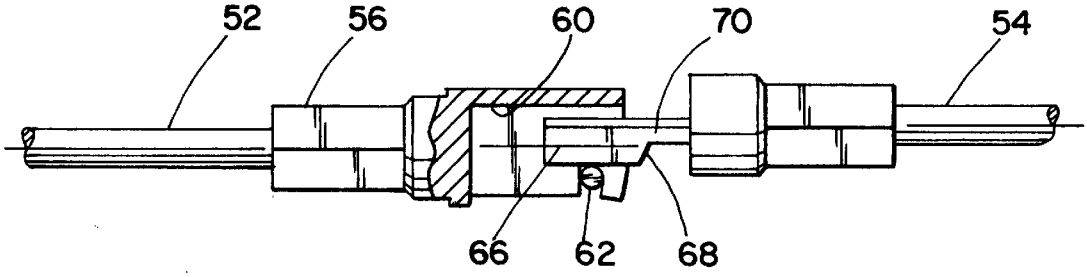

Considering now a second embodiment of the present invention and referring now to FIGS. 7–10, a fusible element 50 includes first and second conductors 52, 54. A first terminal 56 is carried on the first conductor 52 having a cavity 60. A latch element 62 (e.g. pin) is carried by the first terminal 56 within the cavity 60. The second conductor 54 includes a latch member 66 having a ramp surface 68 defining a narrowed section 70. The fusible element 50 is assembled with the latch member 66 positioned with respect to the latch element 62 such that the ramp surface 68 abuts and is held against the latch element 62. Additionally, in this position, fusible material 72 is provided to fill the cavity 60. With the conductors 52, 54 under tension, the force tending to separate the conductors 52, 54 places the fusible material 72 in compression. When the fusible material 72 melts, the latch element moves as shown in FIG. 8 so as to move over the latch element 62. As shown in FIGS. 9 and 10, the latch member 66 moves with the ramp surface 68 moving up and over the latch element 62 so as to permit separation of the conductors 52, 54.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A fusible element comprising two separable conductors and means for releasably securing said two separable conductors including interfitting parts surrounded by fusible material such that forces separating the interfitting parts result in compression forces on the fusible material, said interfitting parts comprising said two separable conductors including respective interfering portions of said separable conductors such that relative movement is required between said interfering portions before they can be separated.

2. The fusible element of claim 1 wherein said fusible material softens sufficiently to permit the release and separation of said interfitting parts in response to predetermined time-current condition.

3. A fusible element comprising two separable conductors and first means for releasably securing said two separable conductors including interfitting parts surrounded by fusible material such that forces separating the interfitting parts result in compression forces on the fusible material, said interfitting parts of said first means comprising a pivotally mounted latch lever carried by a first of said two separable conductors and second means carried by the second of said two separable conductors for cooperating with said latch lever such that said latch lever in a first position retain said second means, and said latch lever upon pivoting to a second position releases said second means.

4. The fusible element of claim 3 wherein said latch lever includes a receiver notch and a first ramp surface having a first predetermined slope with respect to said receiver notch.

5. The fusible element of claim 4 wherein said ramp surface is arranged to provide sufficient force to pivot said latch lever upon tension applied between the two separable conductors while minimizing forces on the fusible material.

6. The fusible element of claim 4 wherein said latch lever includes a second ramp surface having a second predetermined slope greater than said first predetermined slope to increase pivoting force of said latch lever.

7. The fusible element of claim 3 wherein said latch lever is pivotally mounted with respect to a pivot point and along a first surface opposite said receiver notch is tapered so as to reduce the protrusion of said latch lever away from said pivot point.

8. The fusible element of claim 3 wherein said second means includes a hook portion that cooperates with said latch lever.

9. A fusible element comprising two separable conductors, first means carried by said two separable conductors for releasably securing said two conductors, and fusible material surrounding said first means, said first means comprising a second member carried by a first of said two separable conductors and a third member carried by the second of said two separable conductors, said second and third members comprising respective cooperating portions that are arranged in an interfering relationship such that relative movement between said second and third members permits separation of said two separable conductors.

10. The fusible element of claim 9 wherein said fusible material softens sufficiently to permit the release and separation of said two conductors in response to a predetermined time-current condition.

* * * * *